United States Patent [19]

Schmid

[11] 4,121,627

[45] Oct. 24, 1978

[54] WIRE HANDLING APPARATUS FOR AN ELECTRIC COIL FORMING MACHINE

[75] Inventor: Hans Schmid, Rüschlikon, Switzerland

[73] Assignee: Meteor AG, Rüschlikon, Switzerland

[21] Appl. No.: 804,241

[22] Filed: Jun. 7, 1977

[30] Foreign Application Priority Data

Jun. 9, 1976 [CH] Switzerland ..... 7242/76

[51] Int. Cl.[2] ..... B21F 15/00

[52] U.S. Cl. ..... 140/92.1; 242/7.09; 242/25 A

[58] Field of Search ..... 140/1, 92.1; 242/7.09, 242/25 A; 29/605

[56] References Cited

U.S. PATENT DOCUMENTS 3,865,152 2/1975 Camardella ..... 242/7.09

FOREIGN PATENT DOCUMENTS 2,052,001 5/1972 Fed. Rep. of Germany ..... 29/605

32,256 8/1772 Japan ..... 29/605

*Primary Examiner*—Lowell A. Larson

*Attorney, Agent, or Firm*—Cushman, Darby & Cushman

[57] ABSTRACT

The disclosure embraces an apparatus for handling wire at a work station of an electric coil making machine where conductive wire is wrapped around a spool to form an electric coil with a number of spools being carried from work station to work station on spool carriers mounted on a turret head; at a final work station a pair of clamps are mounted on arms which are pivoted from a rest position to a clamping position to grasp and hold the wire extending between adjacent spools on the turret head while the wire is severed by a knife; the length of wire between a spool and an adjacent clamping device is then wrapped on a connecting peg of an individual spool until the wire is broken; the clamping device is then pivoted back to its rest position for disposal of the wire remnants held by the clamping device.

7 Claims, 3 Drawing Figures

WIRE HANDLING APPARATUS FOR AN ELECTRIC COIL FORMING MACHINE

BACKGROUND AND BRIEF DESCRIPTION OF THE INVENTION

The present invention relates to a wire coil forming machine of the type that sequentially passes spools through a plurality of work stations where the spools are successively wrapped with conductive wire or otherwise treated in the manufacturing of such products. At least one of the stations includes a winding station which is adjacent to a final work station or termination point where the tail end of the wire is formed into a contact point for the electric coil.

In known devices, spools which are to be wound with a conductive wire are mounted on spool carriers which, in turn, are carried by a revolving turret head from work station to work station. In one device, such as is disclosed in German Pat. No. 2,018,813, clamping members are employed to handle the wire extending between the already wound spools. Thus, where a turret head has a plurality of spools mounted thereon, it has been necessary to provide clamping elements between two adjacent spindles or spools in order to complete the winding operation. Such finishing procedures usually involve the cutting of the wire and wrapping the tail end of the wire about one or more pegs which protrude from the body of the spindle or spool to thereby provide electric contact points, positive and negative, for each coil. In effecting the attachment of the tail ends of the wire to the contact pegs, it has been necessary to form a wire loop between adjacent spools to assure a sufficient supply of conductive wire for attachment to the connecting pegs of the two adjacent coils before the piece of wire is severed. The length of wire necessary for the winding around the pegs is taken from what is called the reserve loop.

A disadvantage of the known apparatus for effecting these manufacturing steps is the necessity of forming and maintaining the reserve loop between each two adjacent spools mounted on the turret head. That is to say, in the case of a machine with eight spindles, the same number of wire handling implements must be provided which materially increases the costs of the apparatus as well as the cost of operating such a machine.

The present invention provides an improved coil winding machine where the apparatus for producing the final windings on each spool are located only at the termination or last station of the turret head. In particular, the present invention provides clamping means of a novel type and operation at the final work station which will hold the wire and feed it to the final winding device as well as dispose of any remnants of wire remaining. Thus, use of the present invention will avoid the necessity of providing mechanisms for forming the reserve loop between each adjacent coil, thus materially reducing the cost of the machine and improving its manufacturing efficiency by eliminating the necessity of maintaining and adjusting the mechanisms thus eliminated which is of considerable importance where the machine is intended to handle wires having different diameters.

The foregoing and other advantages of the present invention will become apparent as consideration is given to the following detailed description and the accompanying drawings, in which:

DETAILED DESCRIPTION OF THE INVENTION

Figure 1:
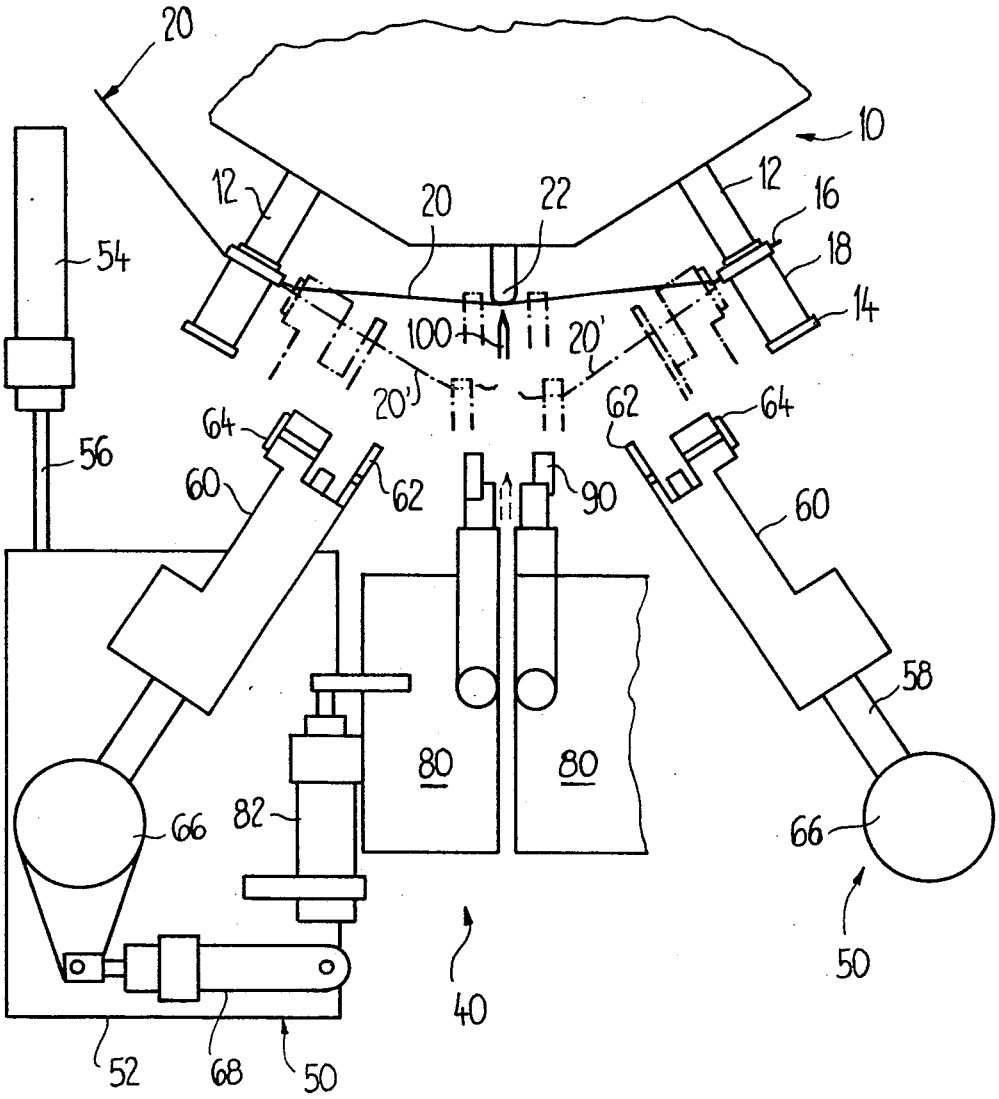
FIG. 1 is a schematic illustration of the various components of a coil forming machine illustrating the relative dispositions of the various elements.

Referring now to the drawings wherein like numerals designate corresponding parts throughout the several views, there is illustrated in FIG. 1 a revolving table or turret head 10 which may have, for example, six radially directed spool carriers 12 mounted thereon, although only two are illustrated. Each spool carrier 12 carries a coil body or core 14 each of which has a plurality of connecting pegs 16, shown more clearly in FIG. 2. The turret head 10 is adapted to rotate the spool carriers 12 from work station to work station, the number of such stations being dependent upon the end use of the coil product. At one of the stations coil windings 18 are put on the core 14 by means of a winding device of conventional arrangement such as a rotating flyer which carries the wire to the core and wraps it as it rotates about the core and translates back and forth parallel to the core axis. With such devices, the coil windings 18 of adjacent core bodies 14 remain interconnected by a length 20 of wire throughout the various work stations through which the turret head 10 moves. In FIG. 1, the final or termination work station is schematically represented and, in the description that follows, it will be assumed that the turret head 10 rotates in a counterclockwise direction to move the carriers 12 through the termination station identified at 40.

Station 40 comprises in a preferred embodiment two finishing units 50 each of which is equipped with a movable carriage 52. The carriage 52 is slidable between a retracted position illustrated by the solid lines to an operation position illustrated by the broken lines adjacent the spool carrier 12 by an hydraulic or compressed air cylinder 54 and piston rod 56. The carriage 52 has mounted thereon a winding head 60 which has a wire guide 62. The winding head 60 is equipped with a winding device 64 on the end thereof remote from support arm 58. The winding device 64 functions to grasp the wire 20 immediately adjacent a peg 16 on the core 14 and, when actuated, wraps the wire about the peg 16. Such winding devices are known and may be manufactured, by way of example, in the manner disclosed in U.S. Pat. No. 4,002,303. The arm 58 is secured to a compressed air cylinder 66 which can be adjusted in height on its piston (not shown) which is secured at its free end to the movable carriage 52. Also, the cylinder 66 is rotatable about a vertical axis by means of an additional pneumatic cylinder and piston arrangement 68 to assure accurate positioning of the winding device 64 about the connecting peg 16.

The finishing unit 50 also includes a slide carriage 80 which is mounted on the movable carriage 52 by means of a piston and cylinder device 82 whereby the slide carriage 80 is capable of movement parallel to the path of travel of the movable carriage 52 but independently thereof. Each of the slide carriages 80 is provided with a wire handling means in the form of a wire clamping device 90, as will be described in more detail hereinafter.

The terminal station 40 is also equipped with a cutting device in the form of knife 100 which is separately actuatable to sever the length of wire 20 passing between the two adjacent carriers 12. To facilitate severing of the wire 20 a guide rib 22 is mounted on the face of the turret head 10.

Figure 2:
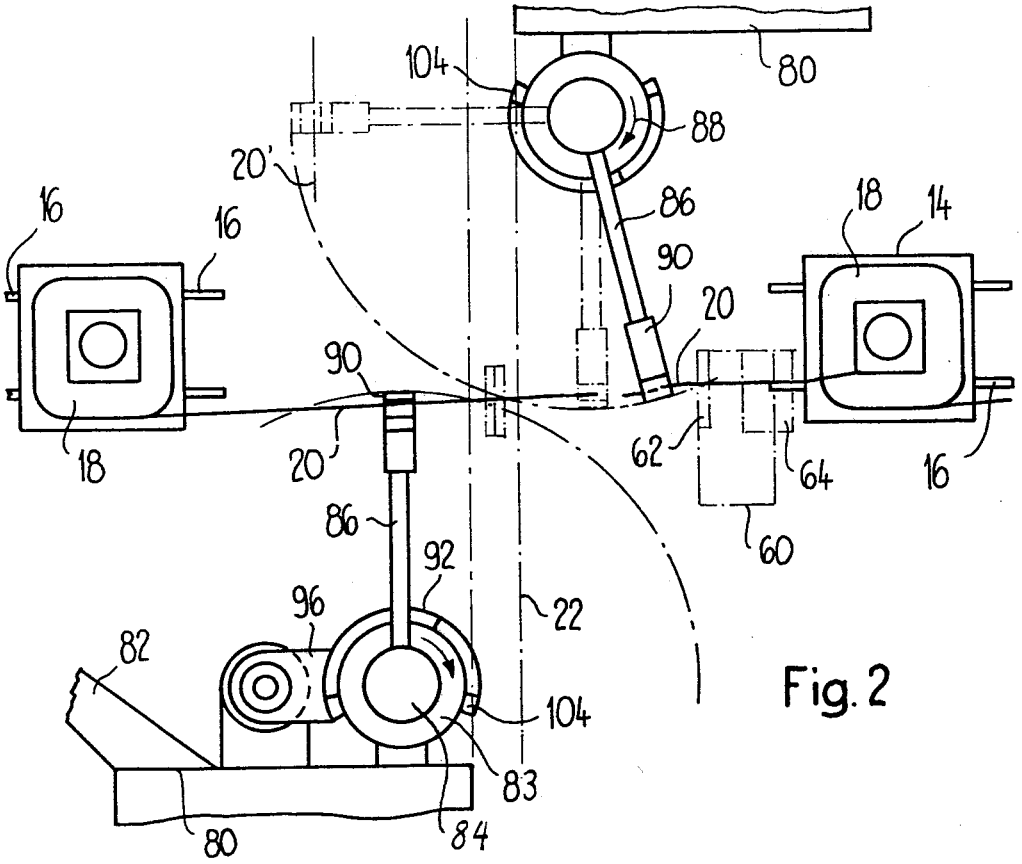
FIG. 2 is a front view of the improvement of the present invention.

Turning now to FIG. 2, there is illustrated in more detail the apparatus of the present invention for handling the wire extending between adjacent coils 18 at the final work station 40. FIG. 2 is a front elevational view looking at the edge of the turret head 10 which carries the guide rib 22 which is shown in broken lines. The cores 14 are thus seen to rotate in a horizontal plane while the two slide carriages 80 are disposed mutually displaced in height and each laterally to one side of the guide rib 22. Each slide carriage 80 is slidable along an axis that extends transversely to the path of the wire 20 with one being located below and the other above wire 20.

Each slide carriage 80 is provided with a bearing sleeve 83 securely mounted on the slide carriage 80. In bearing sleeve 83, there is rotatably positioned a pivot cylinder or pin 84. The pivot cylinder 84 has secured to it a radially projecting clamping arm 86 which has, at its end remote from the pivot cylinder 84, a clamping device 90. A torsion spring constantly acts on the pivot cylinder 84 tending to rotate the cylinder 84 and its associated clamping arm 86 and clamping device 90 in the direction of the arrow 88. The torsion spring acts between the stationary bearing sleeve 83 and the pivot cylinder 84 to thus force the clamping arm to return to a rest position illustrated in broken lines in FIG. 2. The clamping device 90 may comprise claws which may be operated electromagnetically to clamp the wire located between the clamping jaws when the clamping arms have moved to an operating position and to release the wire when the clamping arm returns to its rest position.

Figure 3:
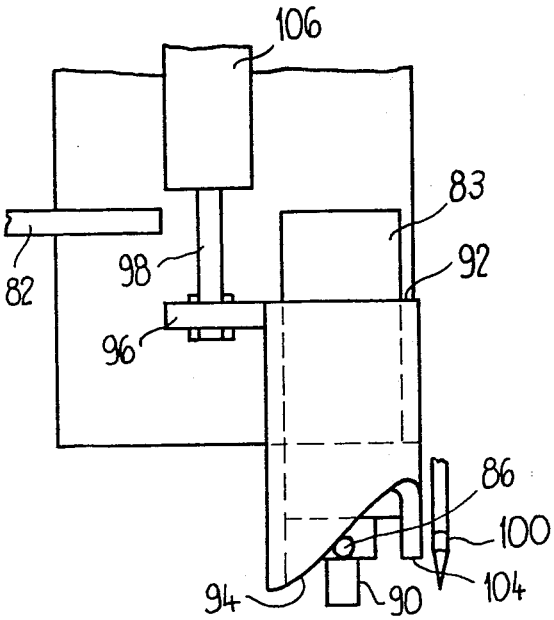
FIG. 3 is a close-up top view of one of the pivot arm mounts of the present invention.

To effect movement of the clamping arms 86, each of the two bearing sleeves 83 carries an axially movable slide member 92 (see FIG. 3) which has on its front surface adjacent the clamping arm 86 a sloping or curved surface 94. The slide 92 is connected through a driving arm 96 to a piston rod 98 of a pneumatic cylinder 106 which is mounted on the slide carriage 80. The sloping surface 94 is always in contact with the clamping arm 86 so that the position of the slide 92 determines the pivot position of the clamping arm 86 and the clamping device 90 by virtue of its position on the bearing sleeve 83.

The operation of the apparatus of the present invention will now be described.

With the wire section 20 located between two wound coils 18 in front of the final work station 40 as shown in solid lines in FIG. 1, the movable carriages 52 of the finishing units 50 are moved forward and the arms 58 swiveled to bring the wire guides 62 and the winding devices 64 on the winding heads 60 into the proper position relative to the connecting pegs 16 on the cores 14. At the same time, by virtue of their connection thereto, the slide carriages 80 are also moved forward or toward the wire 20 but may be moved an additional extent by virtue of operation of the cylinders 82 until the now open clamping devices 90 overlap the taught section of the wire 20 on opposite sides of the guide rib 22. The clamping devices 90 are then closed and the cutting knife 100 is operated to sever the wire section 20 between the clamping devices 90 to form the two wire lengths 20'. Then the slide carriages 80 are retracted to move the clamping devices 90 with the cut sections 20' to the dotted line position of FIG. 1 where the wire-lengths 20' are aligned with the wire guide 62 and the winding device 64. The wire guide 62 will capture and hold the wire sections 20' since the above-described movement of the carriage slide 80 will effect insertion of the lengths 20' in the winding devices 64 and guides 62. Swivelling movement of the winding head 60 by the piston and cylinder units 66 and 68 will then move the winding devices 64 into overlapping connection with the pegs 16. The winding devices 64 are then operated to wrap the thus held wire sections 20' about the respective pegs 16. The required length of wire for permitting the proper winding of the pegs 16 as well as the movement of the winding head 60, if any, is supplied by virtue of the spring mounting of the clamping device 90 and arm 86 as shown in FIG. 2 where the upper arm 86, upon wrapping of the wire about the pegs 16 by the winding device 64 pulls the arm 86 towards the associated wire guide 62. During the operation of the winding device 64, the associated slides 92 are retracted so that only the hold of the clamping devices 90 on the wire 20 restrains the arm 86 from returning to its rest position illustrated in broken lines in FIG. 2 where the arm comes into contact with a stop 104.

The slide 92 is pulled back into a position which limits the maximum angular displacement of the associated arm 86 which can be adjusted for each corresponding core 14 or the final winding length required. Thus, when the maximum desired angular displacement of the arm 86 has taken place as by rotating the slide 92 about the bearing sleeve 82, then further winding by the winding device 64 effects a breakage in the wire between the clamping device and the peg 16. Upon such breakage of the wire section 20', the spring loaded arm 86 will rotate back until it contacts the stop surface 104 on slide 92 with the clamping device 90 retaining any wire remnant.

The clamping device 90 may now be opened and the wire remnant disposed of by simply locating a collection vessel below the rest position of the arm 86 so that the wire remnant will drop under the influence of gravity into the collecting vessel.

For the next operation, the slides 92 may be moved forward again towards the arms 86 so that the arms again extend perpendicular to the wire 20 which is the starting position.

Instead of causing the breakage of the wire by limiting the angular displacement of the arms 86, the winding heads 60 may be provided with a clamping device such as at 62 which will hold the end of the wire while the winding device 64 operates to effect the breakage after the formation of the desired number of windings on the connecting pegs 16.

From the foregoing, it will be apparent that the operation of severing and wrapping the tail end of the wire about the connecting pegs can take place completely at the final work station where the immediately preceding work station functions to wrap the cores 14 to form the coils 18, thus saving considerable time in the formation of these products.

Having described the invention, it will be apparent that various modifications may be made therein without departing from the spirit and scope of the present invention as defined in the appended claims.

What is claimed is:

1. In apparatus for handling an end of wire wrapped on a spool having a peg projecting from the spool, said apparatus being of a type having a turret head including a plurality of spool carriers spaced apart on the head, said head being movable between a plurality of operating stations with one of said stations being a spool winding station and one being a terminal station having at least one peg winding means, the improvement comprising:

said terminal station further including two wire clamping means each mounted for movement between a rest position and a wire clamping position between two adjacent spool carriers on said turret head and cutting means mounted for movement between said two adjacent spool carriers to cut wire clamped by said two wire clamping means.

2. The apparatus as claimed in claim 1 wherein said wire winding means are mounted on a movable carriage means and a said slide carriage is mounted on said movable carriage means and is movable relative thereto.

3. Wire clamping means for use with a spool winding apparatus of the type where wire extends from the spool carrier at a terminal station, said wire clamping means comprising a clamping member, means mounting said member for movement between a rest position and a clamping position, spring means for constantly urging said member toward said rest position and actuating means for moving said member from said rest position to said clamping position and then releasing said member so that said member, urged by said spring means, and when clamping the wire, will hold the wire under tension.

4. Wire clamping means for use at a terminal station of a spool winding apparatus of the type where wire extends between two adjacent spool carriers at the terminal station, said wire clamping means comprising first and second clamping members, each having means mounting said respective member for movement between a rest position and a clamping position, spring means for constantly urging said respective member toward said rest position and actuating means for moving said respective member from said rest position to said clamping position and then releasing said respective member so that said respective member, urged by said spring means, and when clamping wire, will hold the wire under tension.

5. The apparatus as claimed in claim 4 wherein said clamping means each include claw members attached to pivotably mounted arms.

6. The apparatus as claimed in claim 5, wherein said arms are each pivotably mounted on slide carriages slidable towards and away from the wire extending between said spool carriers.

7. The apparatus as claimed in claim 5 wherein said actuating means for each arm each comprises a sleeve member, a rotatably mounted pivot pin at one end of which a said arm is secured, said sleeve member being mounted on said pin so as to be slidable toward and away from said arm, said sleeve member having at one end thereof a sloping surface in contact with said arm and means for sliding said sleeve member along said pivot pin.

* * * * *